LONG-PLAY VIDEO TAPE CASSETTE

FIELD OF INVENTION

The present invention relates to video tape equipment, and more particularly, to a long-play cassette which is constructed and adapted for reception in the short-girth receiver of a customary video tape playing machine engineered for smaller short-play cassettes.

DESCRIPTION OF PRIOR ART

As to conventional video tape players and cassettes, the same are designed for short playing periods of one hour or less and have reels of quite small diameter. These reels are customarily driven by spindles that key directly into the central portions of the reels.

For many types of programs it is highly desired to have cassettes that will store programs of two or three hours, or even more time, in order that a continuous play may be had without cassette substitution. The customary spindle sockets or receivers are conventionally made integral with the reels themselves.

In the past there has been no suitable provision for laterally disposed enlarged reels accommodating lengthened playing time in cassette form for video tape players having the customary slot receptacle for cassettes; likewise, appropriate structure to facilitate long play tapes has been absent in customary cassettes. The solution proposed is to engineer the large-reel cassette to fit laterally next to the player and yet suitable engage the player's receiving slot.

BRIEF SUMMARY OF INVENTION

According to the present invention a video tape cassette has a configurement that includes an enlarged, dimensioned to fit next to the player, base area for large reel mountings and also a tongue forming essentially an inside right angle with the base area, and of restricted dimension which will fit into the receivers of conventional video tape players. The forward and reverse drive spindles of the video tape player enter into meshed or keyed engagement with spindle sockets in the cassette of the present invention, but with such spindle sockets being provided with gear means providing a direct positive drive, via gear belts, with the enlarged video tape reels driven by such gear belts. Hence, the video tape reels are themselves provided with gearing means meshing with such gear belts. Post means are provided the cassette so that the tape will be routed properly into and throughout the tongue area for operation with the magnetic head of the tape player. Accordingly, means are provided for tensioning and otherwise positioning the tape properly in the restricted tongue of the cassette, yet providing for correct take-up and feed by the enlarged reels used. Thus, in the invention, the storate capacity of the new cassette is vastly increased.

OBJECTS

Accordingly, a principal object of the invention is to provide a long play video tape cassette for conventional tape-playing equipment.

A further object is to provide a cassette having an enlarged area for long-play reel mounting and yet a restricted portion that will fit into the receivers of conventional tape players.

A further object is to provide a video tape cassette wherein provision is made proximate the take-off portion of the cassette for ensuring proper routing and retention of the video tape without marring the surfaces thereof.

A further object is to provide a long-play video cassette having a receiver tongue provided with and accommodated by means for restricting the girth of the travel path of the video tape, and this in a manner accommodating proper operation of the enlarged reels of the cassette.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figures 1, 2:
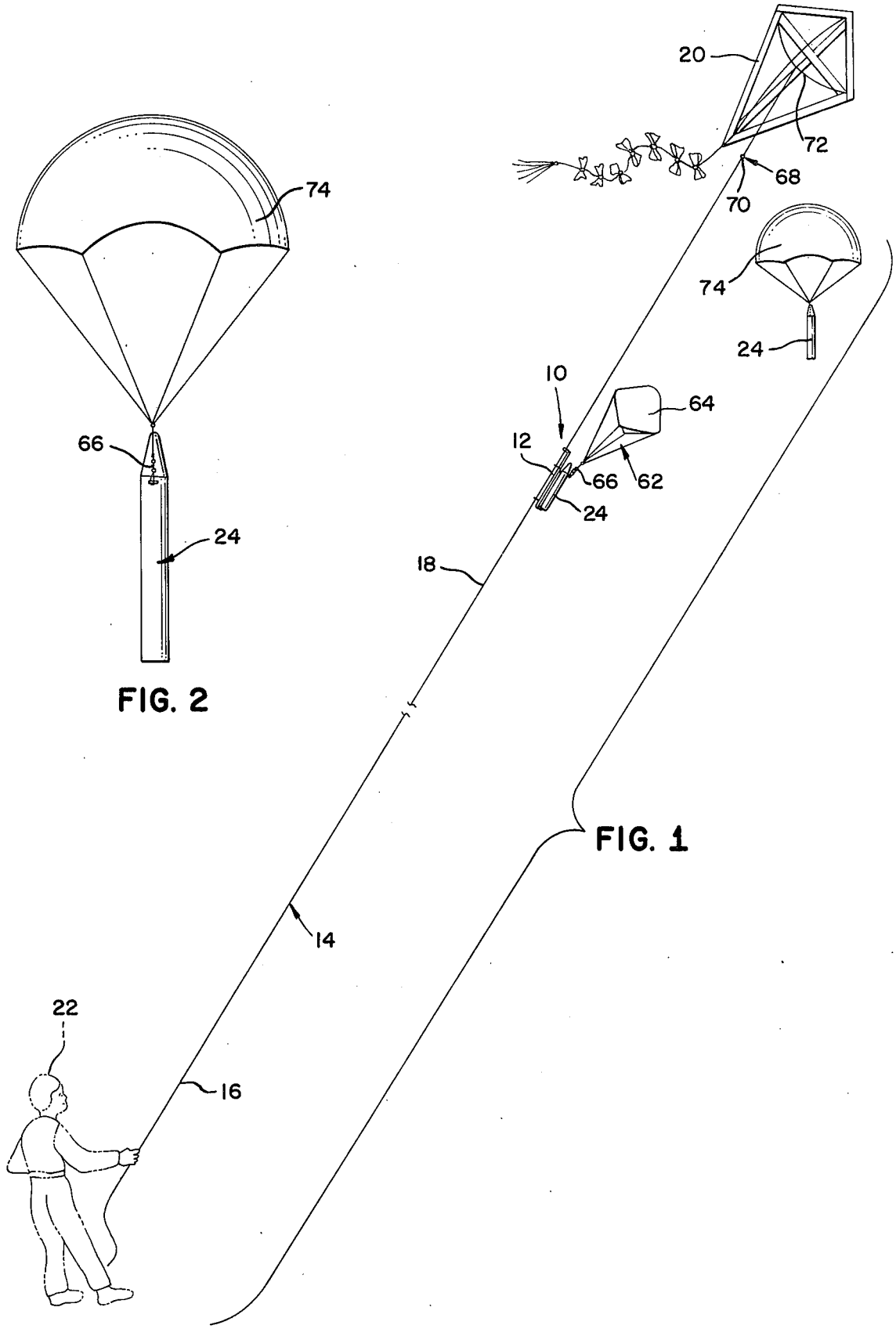
FIG. 1 is a perspective view of a conventional video tape player that can receive the enlarged video tape cassette of the present invention having a tongue designed for placement in the receiver thereof.
FIG. 2 is an enlarged perspective view, partially broken away for convenience of illustration, illustrating the operative parts of the cassette shown in dotted lines in FIG. 1.

In FIG. 1 video tape player 10 is strictly conventional in design and includes the usual cassette receiver 11 comprising a cradle 12, hold-down bar 13 and angle stop means 14. The receiver has a pair of apertures 15 and 16 for receiving the revolving player drive/takeup spindles 17 and 18. These spindles are conventional, are supplied for both forward and reverse drives of conventional players, and include a series of spring-biased upstanding engagement pins 19'. Such spring-biased pins and their spindles are strictly conventional in any present-day video tape players and of themselves form no part of the present invention.

Phantom lines 19" indicate the position of longplaying cassette 19 of the present invention. The cradle 12 in essence defines the outline of a normal, short-play cassette having a one hour or less capacity. Thus, the customary short play reels will be engaged directly by spindles 17 and 18, and the reels will be contained completely within cradle 12 of the receiver 11.

The new, long-play cassette in this invention is essentially L or T configured and in any event will have an insertion tongue 20 which will fit the receiver 11 for insertion placement therein. Hold-down bar 13 keeps the tongue in proper downward position at all times. The tongue 20 and receiver 11 are essentially rectangularly configured and in normal or 90° relationship relative to player planar surface 65, all as shown in FIG. 1. Likewise, and as shown in FIG. 2, surfaces 20A and 21B

12
14
24
26
28
30
32
34
36
38
40
44
46
48
50
52
54
56
58
60
66
68
70

AERIAL DEVICE

BACKGROUND OF THE INVENTION

The present invention relates to a novel aerial device. Aerial devices such as kites, balloons, airplanes, parachutes and the like were conceived in relatively recent times. For example, Leonardo da Vinci anticipated the idea of a parachute in the year 1514. The parachuting items from the air to the ground had been successfully accomplished by the eighteenth century A.D.. Also, the art of raising kites and similar devices by means of lines or cords held in hands or wound on reels was accomplished by the early Greeks.

Early aeronauts used parachutes to descend from balloons in emergency situations. Later developments saw the use of parachutes carried aloft by airplanes and rockets to safely light biological and inanimate objects to earth.

As such, no prior known art describes a device which combines a parachute with an elevated line.

SUMMARY OF THE INVENTION

In accordance with the present invention, a novel aerial device is provided and includes support means releasably gripping the object which may be connected to flight means such as parachute means. The supporting means releasably grips the object and connected parachute means while bearing on the elevated line. The supporting means may be a pair of adjacent members such as rods confined to a certain range of distances therebetween. Restricting means such as a collar may extend from the second member and loosely encloses the first member.

Urging engagement of the object by the first and second members is spring means which may externalize in an elastic band, coiled spring, leaf spring and any other equivlent spring.

A force opposite to the force of such spring means results in disengagement of the first and second members from the object. This opposite force generates with activating of the trigger means which may embrace an abutment fixed on the elevated line. The first or second member contacts the abutment, which in the case of two rods would cause relative opposite axial movements therebetween. Such opposite axial movements would overcome the spring force and thus obviate the gripping engagement of the object by the support means. The parachute means would then float the object to the ground surface. If the elevated line is at least slightly inclined, a situation found while flying a kite, balloon or the like, the support means would run back down the line to the lowest point thereof.

The device moves along the elevated line by employing traveling means. Although the device may wheel, bounce, spiral and follow many paths along the elevated lines, the simplest method of travel is a sliding motion through a loop. The parachute means enveloping moving air may be employed as the propelling means to motivate the device along the elevated line. Other sources of energy such as a self contained battery, solar energy and the like may be used to transport the object and parachute means along the elevated line for a predetermined release therealong. Use of an open loop, preferrably helical would permit rapid attachment and removal of the object and parachute means from the elevated line. An abutment affixed to the line colliding the support means may provide the triggering force necessary to release the object.

To prevent twisting and fouling of the device during movement along the elevated line, swivel means such as a snap swivel may be used to connect the object to the parachute means.

As may be seen, a novel and useful aerial device has been described and it is therefore an object of the present invention to provide a device to transport an object along an elevated line and to release the same for slowed travel ground surface after movement of the object a predetermined distance along the line.

It is another object of the present invention to provide an aerial device which may take the format of a toy which readily attaches to a kite line for launching and recovering objects.

It is yet another object of the present invention to provide an aerial device which repeatedly moves along an elevated line and back again without removal of the line and erecting of the line thereafter.

It is still another object of the present invention to provide an aerial device which employs parachute means to move an object along the line and to arrest its fall to the ground surface after its release from engagement of the elevated line.

Another object of the present invention is to provide an aerial device which may be attached for movement along an elevated line and detached at selected points along said elevated line.

The invention possesses other objects and advantages especially as concerns particular features and characteristics thereof which will become apparent as the specification continues.

Various aspects of the present invention will evolve from the following detailed description of the preferred embodiments thereof which should be taken in conjunction with the accompanying drawings.

BRIEF DESCRIPTION OF THE DRAWINGS

FIG. 1 is a overall view of an embodiment of the device showing its dynamic aspects.

FIG. 2 is a side view of an embodiment of the device descending.

Figures 3, 4, 5, 6, 7:
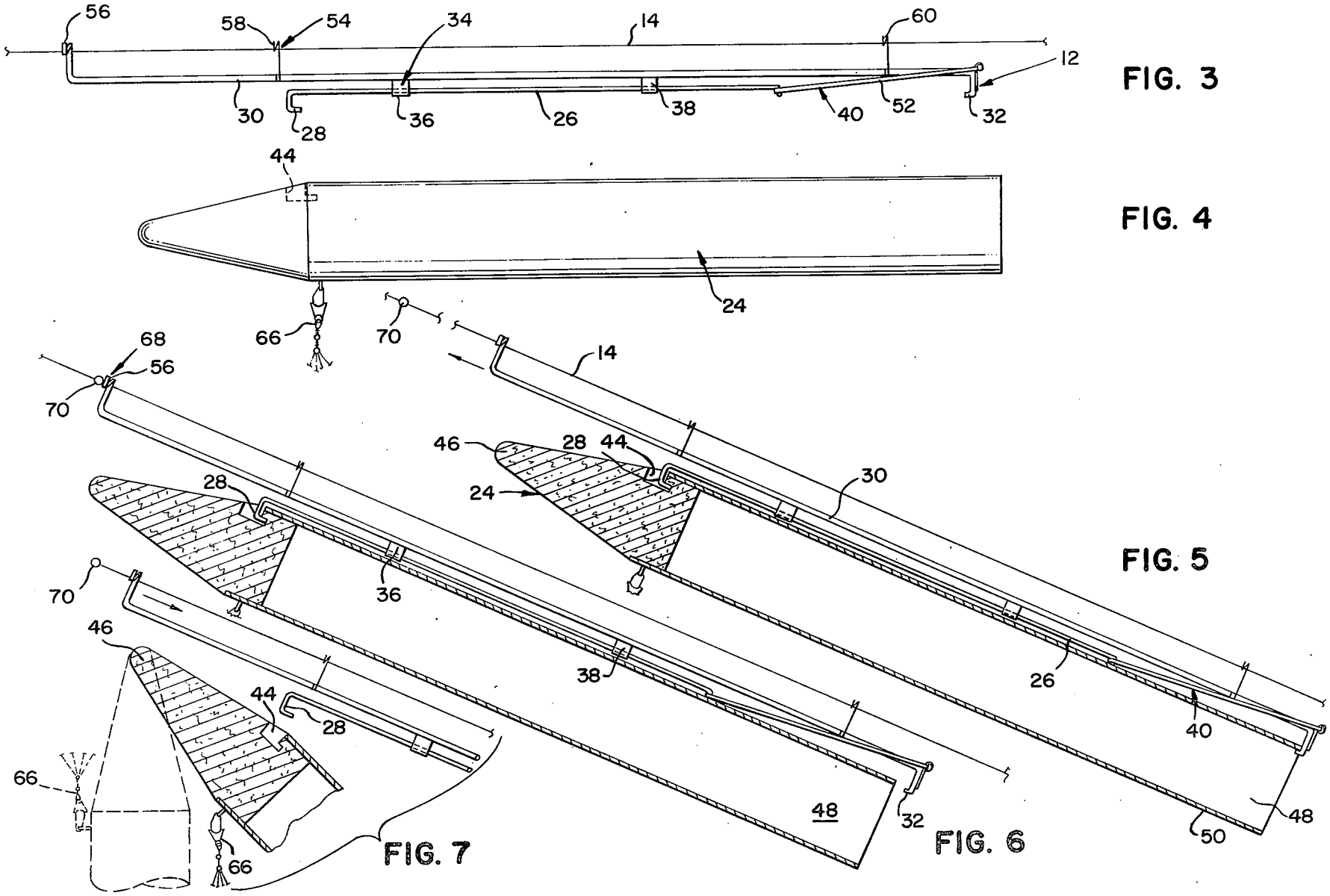
FIG. 3 is an enlarged vertical section taken along the dotted line 3—3 in FIG. 2.
FIG. 4 is a horizontal section taken along the line 4—4 in FIG. 2 and illustrates in enlarged fragmentary view the operative and associate structure proximate the takeoff area of the cassette.
FIG. 5 is an enlarged fragmentary vertical section taken along the line 5—5 in FIG. 2, illustrating a representative video tape constraining roller or sleeve structure employed at various points in the cassette.

FIG. 3 is a side view of a portion of the device.

FIG. 4 is a side view of the object carried by an embodiment of the device.

FIG. 5 is a side sectional view of the object of FIG. 4 showing the engagement of the support means of FIG. 3.

FIG. 6 is a side view partially in section along 5—5 of FIG. 4 showing partial disengagement of the support means from the object.

FIG. 7 is a partially broken side view, partially in section showing the full disengagement of the support means from the object and the subsequent movement of the object in phantom.

DESCRIPTION OF THE PREFERRED EMBODIMENTS

The invention as a whole is shown in the drawings and described herein by reference character 10. An elevated line 14, may be raised evenly along its length above a ground surface or on one end or the other. As shown in FIG. 1, the line 14 has end portions 16 and 18. In general, end portion 18 is higher from the ground surface than end portion 16. End portion 18 may be affixed to a body and is shown in the present embodiment to be attached to a kite 20. The end of end portion 16 is being held by a person 22 flying the kite 20.

An object is releasably gripped by support means 12, an element of the device 10, which is itself born by the elevated line 14. Turning to FIG. 3, support means 12 may take the form of first member 26 in the configuration of an elongated rod which includes a hook 28 at one end thereof. Likewise, a second member 30 may assume the form of a rod having a hook 32 at one end thereof. Second member 30 may include confining means 34 for restricting the distance between first and second members 26 and 30. Such confining means may take the form of a pair of collars 36 and 38 which fit around first member 26 and append from the second member 30. It may be apparent that the collars 36 and 38 may append and fit oppositely, an equivalent variation. Spring means 40 urges engagement of hooks 28 and 32 of members 26 and 30 to object 24 which may be constructed according to any shape and size format. As illustrated in FIGS. 1, 2 4–7, the object 24 appears as a miniature rocket having a recess 44 near its nose 46 and a cavity 48 near its tail 50. Spring means 40, which is depicted in the form of an elastic band 52, pulls both hooks 28 and 32 together, squeezing them into recess 44 and cavity 48. As can be surmised, a force in the opposite direction to the spring means force would disengage hooks 28 and 32.

Traveling means 54 carries object 24 along elevated line 14 and is embodied in the drawings as helical loops 56, 58 and 60 fastened to member 30 of support means 12. Loops 56, 58, and 60 slide along elevated line 14. Propelling means 62 moves the object 24 and attached support means 12 along the elevated line, FIG. 1. Many mechanisms such as spring wound propellars, line gripping wheels activated by batteries or other energy sources, and the like may be employed as propelling means 62. Where the object travels from a higher to lower point ie: when end portion 16 is higher than end portion 18, gravity would serve as propelling means 62. The embodiment shown in the drawings uses parachute means 64 to perform the task of propelling means 62 when kite 20 affixes to the end of line 14. The wind force maintaining kite 20 aloft would also drive parachute means 64 and attached object 24 toward kite 20. Swivel means 66 attaches parachute means 64 to object 24 and prevents twisting and/or fouling of the traveling means 54, as it rides the line 14.

Trigger means 68 initiates the release of the members 26 and 30 of support means 12 gripping object 24, FIG. 5. Trigger means 68 may embrace abutment 70 which fixes on the elevated line 14. For instance, abutment 70 may be lead split shot compressed into place as shown, FIG. 1. Also, the confluence of the line 14 and bridle 72 may serve as abutment 70, FIGS. 5–7, and counteract the spring force of spring means 40. When the spring force is overcome, the hooks 28 and 32 will leave recess 44 and cavity 48, thus freeing object 24 from support means 12.

After being released from support means 12, object 24 may fall naturally, via the force of gravity, to the surface where the person 22 or other persons, animals, or machines may recover the object 24. The device 10 may further include flight means 74 such as a propellar, rocket, spring, wings and the like to interrupt the gravitational descent of the object 24. As shown, parachute means 64 also serves as flight means 74 to arrest the descent of object 24. Coloration of the parachute means 64 will aid in its recovery.

In operation the person 22 attaches the support means 12 to elevated line 14 by placing line 14 within helical loops 56, 58, and 60. The object 24 releasably attaches to support means 12 via members 26 and 30, cooperating via spring means 40 to force hooks 28 and 32 into recess 44 and cavity 48. Traveling means 54 such as parachute means 64 and slidably loops 56, 58, and 60 carry the device 10 along, down, or up line 14. Trigger means 68 initiates the release of support means 12 by the collision of member 26 or 30 with abutment 70. Such collision force overcomes the spring force holding hooks 28 and 32 into recess 44 and cavity 48, to release object 24 from support means 12. Flight means 74 then controls the descent or movement of object 24 until touching the surface. Support means 12 will return to the end portion 16 of line 14 when it is at a lower point than end portion 18. Thus, another object 24 may be caused to move along line 14 without removal and erection of line 14.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. An aerial device in combination with an object transportable along a line elevated above a surface, the improvement comprising:

a. support means intended for releasably gripping the object, said support means being born by the elevated line, said support means comprising a first member engaging the object toward one end thereof; a second member engaging the object toward the other end thereof, said second member including confining means for restricting the distance between said first member and said second member, said first and second members acting in concert by said engagements to effect the intended support of the object; and spring means for urging gripping engagement of the object by said first and second members, said urging engagement of said spring means guided by said confining means, said spring means allowing disengagement of the object by said first and second members;

b. traveling means intended for carrying the object along the elevated line;

c. trigger means for initiating the release of said support means gripping the object, thereby overcoming the spring force of said spring means urging engagment of the object by said first and second members.

2. The aerial device of claim 1 in which said trigger means comprises an abutment fixed on the elevated line which selectively contacts said first and second members and provides a force that overcomes said spring means urging engagement of the object by said first and second members.

3. The aerial device of claim 2 in which said traveling means includes at least one open loop fastened to said support means and slidable along the elevated line and propelling means intended for moving the object along the elevated line.

4. The aerial device of claim 1 which additionally comprises flight means intended for interrupting the gravitational descent of the object from the elevated line to the surface after release of the object by said support means.

5. The aerial device of claim 4 in which said trigger means comprises an abutment fixed on the elevated line which selectively contacts said first and second members and provides a force that overcomes said spring means urging engagement of the object by said first and second members.

6. The aerial device of claim 5 in which said traveling means includes at least one open loop fastened to said support means and slidably along the elevated line and propelling means intended for moving the object along the elevated line.

7. The aerial device of claim 6 in which said flight means comprises parachute means intended for holding the object and intended for arresting the descent of the object to the surface.

8. The aerial device of claim 7 in which said propelling means comprises parachute means intended for pulling the object along the elevated line, said parachute means and the object connected to swivel means therebetween.

* * * * *